United States Patent [19]

Tegg et al.

[11] Patent Number: 4,744,111

[45] Date of Patent: May 17, 1988

[54] KNOCK-DOWN COMMODE

[75] Inventors: Duane T. Tegg; Perry M. Domaas, both of Brooklyn Center, Minn.

[73] Assignee: Satellite Industries, Inc., Minneapolis, Minn.

[21] Appl. No.: 879,031

[22] Filed: Jun. 26, 1986

[51] Int. Cl.[4] ..... E04H 1/12; A47K 11/02

[52] U.S. Cl. ..... 4/460

[58] Field of Search ..... 4/596, 599, 600, 612, 4/614, 460–463; 52/127.8, 127.9, 264, 578, 582, 584

[56] References Cited

U.S. PATENT DOCUMENTS

| | | | |
|---|---|---|---|
| 1,928,924 | 10/1933 | Barce | 52/264 |
| 2,019,692 | 11/1935 | Mueller | 52/582 X |
| 2,472,981 | 6/1949 | Miller | 52/582 |
| 2,629,139 | 2/1952 | Thelander | 52/578 |
| 2,793,401 | 5/1957 | Paschke | 52/264 |
| 3,019,863 | 2/1962 | Kearns | 52/582 |
| 3,296,756 | 1/1967 | Wade | 52/127.9 X |
| 3,681,886 | 8/1972 | Ekstrom | 52/582 X |
| 3,845,590 | 11/1974 | Ertl | 52/582 X |
| 4,065,885 | 1/1978 | Blick et al. | 52/264 X |
| 4,577,351 | 3/1986 | Harding | 4/460 |

*Primary Examiner*—Charles E. Phillips

*Attorney, Agent, or Firm*—Herman H. Bains

[57] ABSTRACT

A portable knock-down toilet structure includes a base, vertical side, front and rear walls, and a top wall. The vertical walls each have slots in the lower edge portion thereof which engage clips on the base to detachably secure the vertical walls to the base. Elongate U-shaped corner members each have a plurality of pins which engage in slots in adjacent vertical edges of a pair of adjacent vertical walls to releasably secure the walls together. Each vertical wall has a plurality of cam locks pivoted along the upper edge portion thereof which engage in slots in the top wall to releasably secure the latter to the vertical walls.

9 Claims, 2 Drawing Sheets

Fig. 3
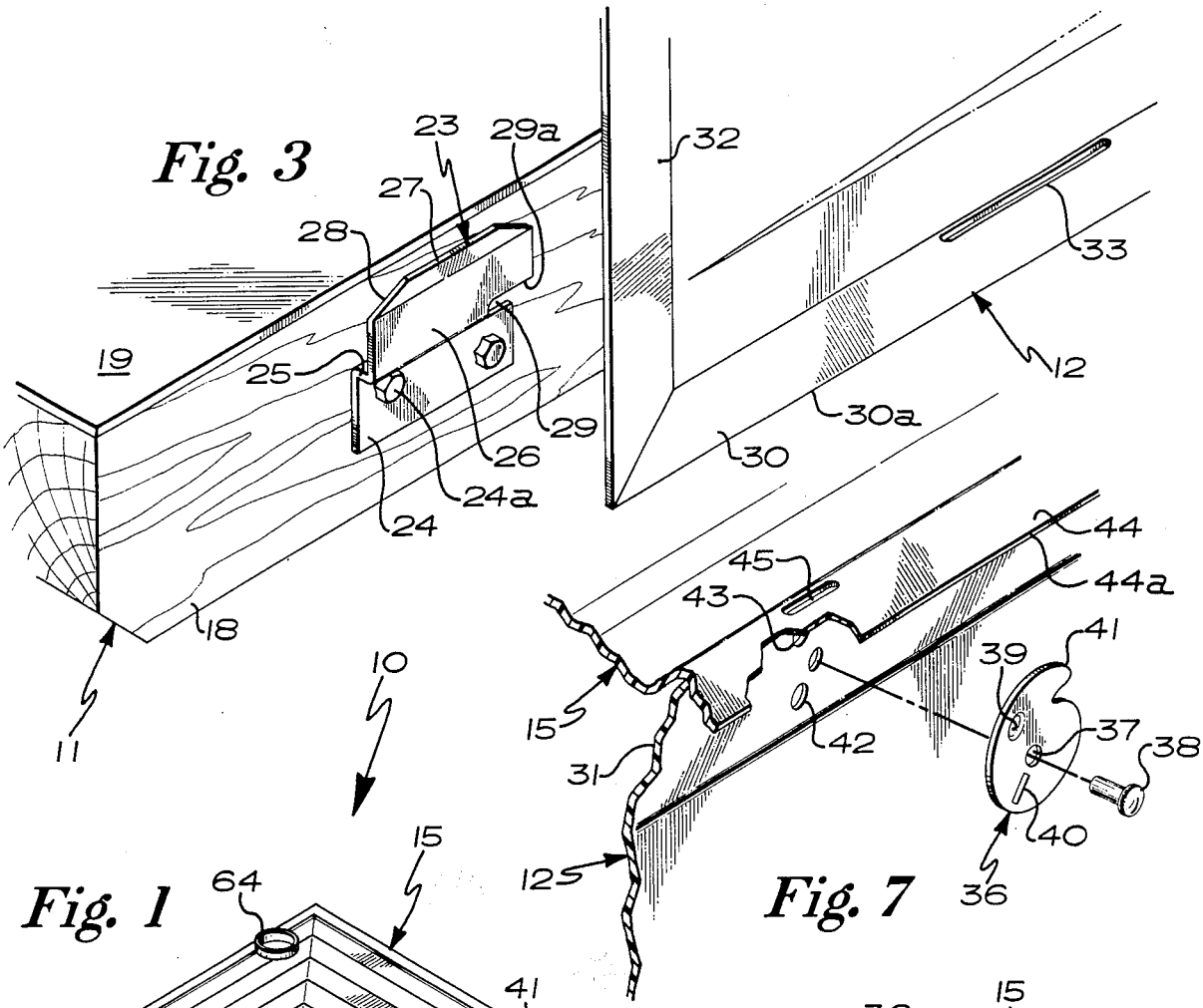
Fig. 7
Fig. 1
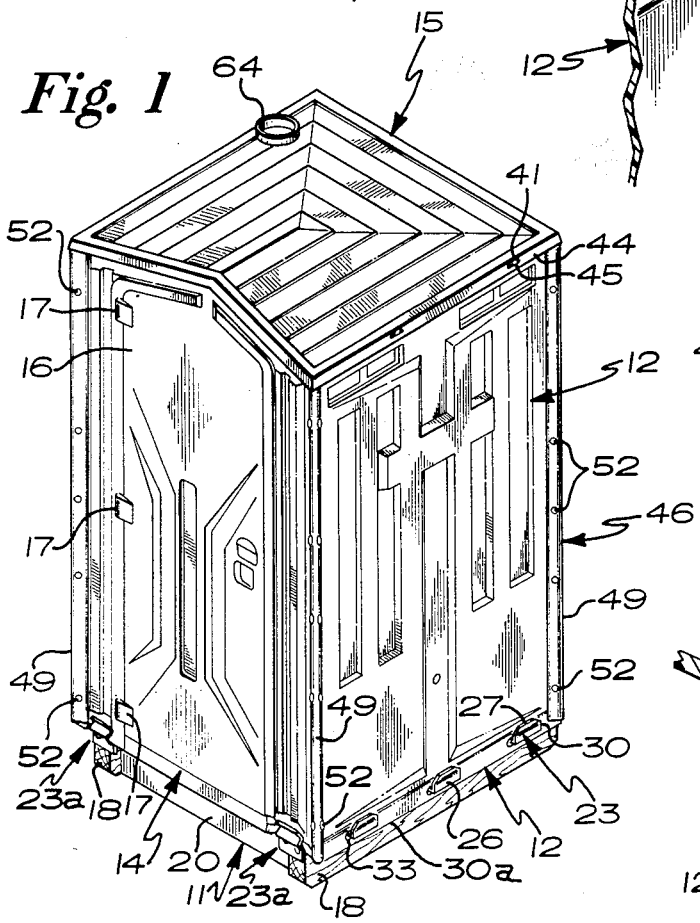
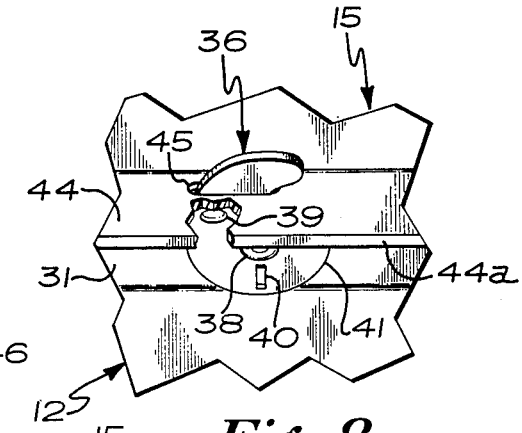
Fig. 8
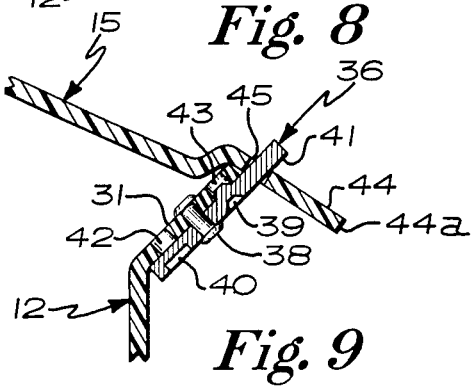
Fig. 9

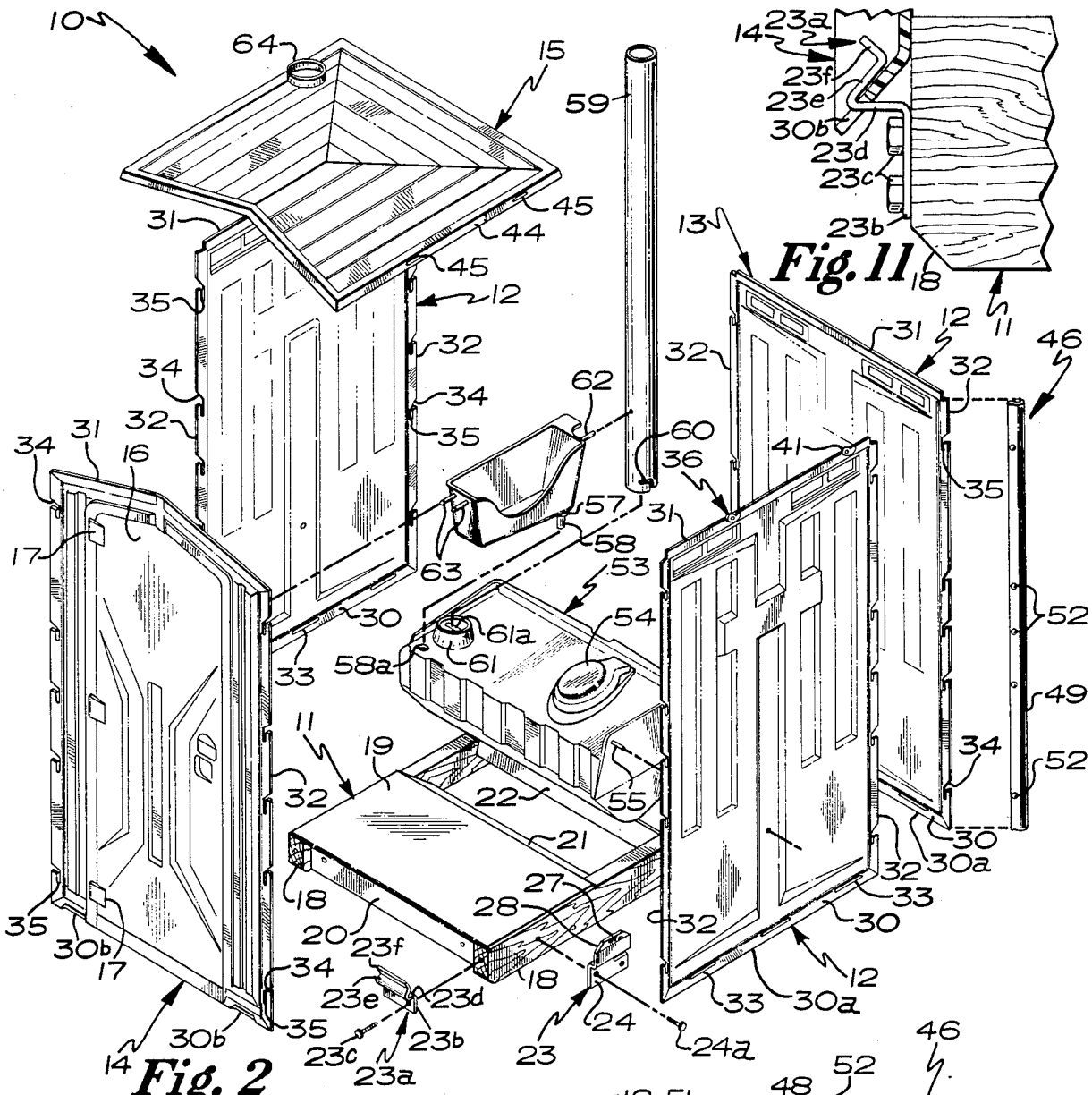
Fig. 2
Fig. 11
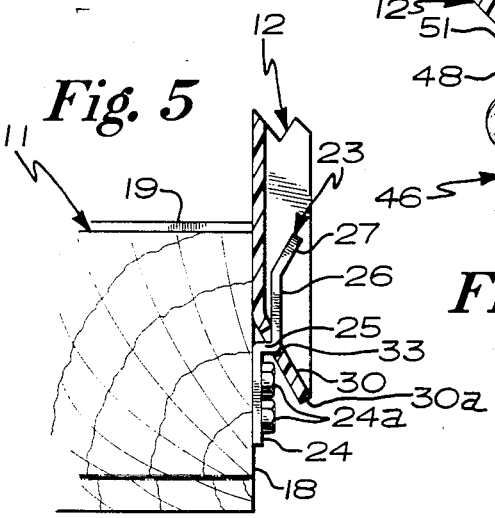
Fig. 5
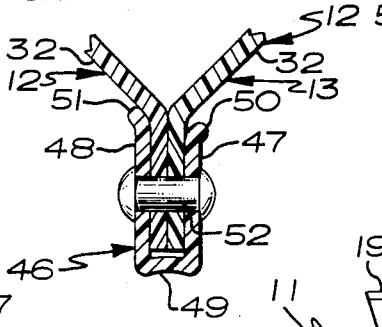
Fig. 6
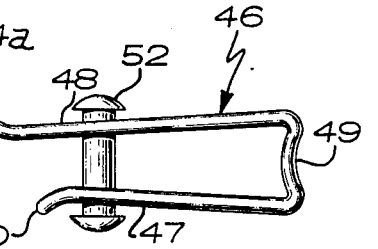
Fig. 10
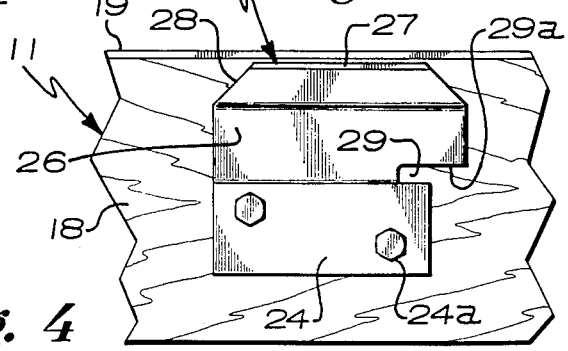
Fig. 4

KNOCK-DOWN COMMODE

This invention relates to a portable toilet structure and, more specifically, to a knock-down portable toilet structure.

BACKGROUND OF THE INVENTION

There are various types of portable chemical toilet structures which have special utility as temporary rest rooms for outdoor concerts, athletic events, and the like. Many of the portable units must be transported in an assembled condition, thereby limiting the number of units which may be transported by a carrier. There have been attempts to develop knock-down units to permit a larger number of units to be transported on each carrier vehicle, but disassembly and reassembly of these units is usually a time-consuming operation.

For example, U.S. Pat. No. 4,493,118 discloses a collapsible toilet shelter which may be collapsed into a transport condition by folding. U.S. Pat. No. 4,505,164 discloses a portable knock-down toilet structure, including a base, top wall, and vertical walls. The vertical walls are somehow connected to corner members 44, although the precise manner is not clearly disclosed.

U.S. Pat. No. 4,065,885 discloses a portable knock-down toilet structure, including a base, roof, and vertical walls which are interconnected together by posts. The vertical walls are inserted into channel-shaped grooves in the corner post during assembly. Finally, U.S. Pat. No. 1,054,317 discloses a knock-down toilet structure which is formed of metal and in which the rolled edges of the vertical walls can be inserted in locked relation in corresponding edges on adjacent walls.

SUMMARY OF THE INVENTION

It is an object of this invention to provide a portable knock-down toilet structure, of simple and inexpensive construction, which may be readily assembled for use and readily disassembled for transport.

Another object of this invention is to provide a portable knock-down toilet structure having vertical walls provided with slots in the edges thereof, and U-shaped clamping members having pins which engage the slots so that each clamping member releasably clamps the edges of a pair of adjacent walls.

A further object of this invention is the provision of a portable knock-down toilet structure in which the lower edge portions of the vertical walls are provided with slots for quick releasable engagement with clips secured to the base to permit ready attachment and detachment of the vertical walls to the base.

A further object of this invention is the provision of a portable knock-down toilet structure in which the top wall is releasably secured to the vertical walls by cam locks mounted on the vertical walls and engageable with the slots in the top wall.

These and other objects of the invention will be more fully defined in the following Specification.

FIGURES OF THE DRAWING

FIG. 1 is a perspective view of the novel portable knock-down toilet structure;

FIG. 2 is an exploded perspective view thereof, illustrating the relationship of the various parts;

FIG. 3 is a fragmentary perspective view, illustrating the manner in which a side wall is secured to the base;

FIG. 4 is a fragmentary elevational view of a portion of the base;

FIG. 5 is a cross-sectional view, illustrating the manner in which a vertical wall is secured to the base;

FIG. 6 is a cross-sectional view, illustrating the manner in which a pair of vertical walls are secured together;

FIG. 7 is an exploded fragmentary view of a portion of the toilet structure, illustrating the manner in which the top wall is secured to a vertical wall;

FIG. 8 is a perspective view, illustrating in detail the manner in which a vertical wall is secured to the top wall;

FIG. 9 is a cross-sectional view, illustrating the locking means for releasably locking the vertical wall to the top wall;

FIG. 10 is a plan view of a clamping member illustrating its configuration and a rivet secured thereto; and FIG. 11 is a fragmentary cross-sectional view illustrating the manner in which the front wall is secured thereto.

DESCRIPTION OF THE PREFERRED EMBODIMENT

Referring now to the drawings, and, more particularly, to FIGS. 1 and 2, it will be seen that one embodiment of the novel portable knock-down toilet structure, designated generally by the reference numeral 10, is thereshown. The toilet structure includes a generally rectangular-shaped base 11, a pair of opposed, generally rectangular-shaped side walls and a rear wall 12, a front wall 14, and a roof 15. The side walls and rear wall are identical in construction and are designated by the reference numeral 12, while the front wall 14 has a doorway and a door. It will will be seen that the roof 15 is inclined and defines a peak or hip at its central portion. The front wall 14 has a doorway opening therein which is closed by a suitable door 26 hingedly connected to the front wall by hinges 17. The door is also provided with a suitable latch mechanism (not shown) to permit a user to latch the door from the inside.

The base 11 is provided with a pair of elongate, substantially straight skids 18, which are formed of wood or the like, and which extend in a fore and aft direction. A floor 19 is secured to the skids 18, and a front transverse member 20 extends between and is rigidly secured to the skids 18 and to the floor 19. It will be noted that the floor 19 does not extend the full length of the skids 18 and the rear edge portion of the floor is connected to an inclined intermediate transverse member 21. It will be noted that the intermediate transverse member 21 is inclined downwardly and rearwardly. A rear transverse member 22 rigidly interconnects the rear end portions of the skids, and this rear transverse member is inclined downwardly and forwardly. The space between the intermediate transverse member and the rear transverse member accommodates the lower end portion of a holding tank in a manner to be more fully described hereinbelow.

The base 11 is provided with a plurality of identical clips 23, which are formed of a suitable metal, and which project outwardly therefrom. In the embodiment shown, each skid 18 and the rear transverse member 22 have three clips 23 secured thereto, while the front transverse member 20 also has two spaced apart clips **23*a* secured thereto. The clips 23 or the skids and rear transverse member are used to secure the side and rear walls to the base 11, while the clips 23***a* are used to secure the front wall 14 to the base.

In the embodiment shown, each clip 23 includes a substantially flat attachment portion 24 which is rigidly secured to the associated skid, front transverse or rear transverse member by suitable bolts 24*a*. Each clip also includes an offset portion 25, which is integral with the attachment portion 24 and projects outwardly therefrom in right angular relation therewith. The offset portion 25 of each clip is integral with a locking portion 26, which projects upwardly therefrom, and each clip terminates upwardly in an upper portion 27, which is inclined outwardly. It will also be noted that the upper portion 27 has converging edges 25 that extend in an upward direction. It will further be noted that the locking portion 26 has a locking notch 29 therein to define a locking shoulder 29*a*, as best seen in FIGS. 3 and 4.

Referring now to FIG. 11, it will be seen that the clips 23*a*, which are secured to the front transverse member 20 of the base 11, are somewhat different in construction than the clips 23. In this regard, each of the clips 23*a* includes a substantially flat attachment portion 23*b* having openings therein for accommodating bolts 23*c* for securing the clip 23*a* to the base 11. Each clip 23*a* also includes a horizontal portion 23*d* that projects outwardly and forwardly from the attachment portion 23*b* in substantially right angular relation therewith. An intermediate portion 23*e* is integral with the horizontal portion 23*d* and projects therefrom in acute angular relation therewith. In the embodiment shown, the intermediate portion 23*e* extends rearwardly and upwardly from the horizontal portion 23*d* and forms an acute included angle therebetween. The intermediate portion 23*e* terminates in an outwardly and upwardly projecting terminal portion 23*f*.

Referring again to FIG. 2, it will be seen that the vertical front, rear, and side walls of the portable knock-down toilet structure are formed of a suitable molded plastic and have a number of molded-in features, imparting both strength and enhancing the aesthetic appearance thereof. Similarly, the roof 15 is also formed of a suitable molded plastic so that the entire toilet structure is of lightweight, but rigid construction.

Each of the vertical side, front, and rear walls has a lower edge portion 30, which is flared downwardly and outwardly, as best seen in FIGS. 3 and 5. Similarly, each of the vertical walls also has an upper edge portion 31, which is flared outwardly and upwardly, as best seen in FIGS. 7 and 9. Finally, each of the vertical walls also has a pair of vertical edge portions 32 that are flared outwardly, as best seen in FIG. 6.

The lower edge portion 30 of each of the vertical front and rear walls has a plurality of elongate spaced apart transversely extending slots 33 therein. The slots 33 receive the clips 23 on the base to secure the vertical walls to the base. It will be noted that the slots 33 extend substantially parallel to the lower edge 30*a* of the associated vertical wall. Each of the vertical edge portions 32 of each vertical wall also has a plurality of vertically spaced apart keyhole-shaped slots 34 therein, which open outwardly, and which terminate in downwardly extending portions 35. The lower edge portion of the front wall 14 has a pair of recesses 30*b* therein, as best seen in FIGS. 2 and 11.

Referring now to FIGS. 7, 8, and 9, it will be seen that the side, front, and rear walls each have a plurality of spaced apart cam locks 36 pivotally connected to the upper edge portion 31 thereof. Each cam lock 36 is formed of a suitable metallic material and has an opening 37 therein through which projects a pivot pin 38. In the embodiment shown, pivot pin 38 comprises a rivet which pivotally connects each cam lock to the associated upper edge portion of the associated vertical wall. Each cam lock 36 also has an inwardly struck detent 39 therein, and also has a slot 40 therein for accommodating the end of a conventional screw driver. Each cam lock also includes an eccentric locking hook 41, as best seen in FIGS. 7 and 8. The upper peripheral edge portion 31 for each vertical wall has a lower detent opening 42 and an upper detent opening 43 therein adjacent each cam lock. The detent 39 engages the detent opening 42 when the cam lock is in the unlocked condition and engages detent opening 43 when the cam lock is in the locked position.

The top wall 15 is also provided with peripheral edge portions 44 that are offset upwardly from the remaining portion of the top wall, as best seen in FIGS. 8 and 9. The peripheral edge portions 44 have spaced apart elongate slots 45 therein, each of which accommodates the locking hook 41 of a cam lock therein to secure the top wall to the vertical walls. It will also be noted that each slot 45 extends substantially parallel to the associated edge 44*a* of the top wall 15.

Referring now to FIGS. 2 and 6, it will be seen that the toilet structure includes four identical elongate U-shaped clamping members 46. These clamping members are preferably formed of an extruded high density polyethylene, and each includes a leg 47, a longer leg 48, the legs being interconnected by a bight portion 49. It will be noted that the legs 47, 48 converge slightly towards each other and that the leg 47 terminates in an outturned end 50, while the leg 48 terminates in an outturned end 51. It will further be noted that the end portions of the legs are arcuate, as best seen in FIG. 6. Each clamping member is also provided with a plurality of vertically spaced apart pins 52, which extend between and are secured to the legs 47, 48. In the embodiment shown, the pins 52 comprise rivets, and the number of pins correspond to the number of slots 34 in each vertical edge. Each clamping member receives the vertical edge portions 32 of a pair of adjacent vertical walls, and the pins of each clamping member engage in the slots 34 to releasably interconnect a pair of vertical walls together.

Referring again to FIG. 2, it will be seen that the portable toilet structure includes a holding tank 53, which is adapted to contain a suitable chemical, and the holding tank is provided with a toilet seat 54 of well-known construction. It will be noted that the holding tank 53 has front and rear walls that converge downwardly towards each other and are received within the recess defined between the intermediate transverse member 21 and the rear transverse member 22 of the base 12. The inclined surfaces defined by these transverse members mate with and engage the inclined lower front and rear wall portions of the holding tank 53.

The holding tank 53 is also provided with a pair of laterally projecting pins 55 that are received within openings in the side walls 12. A urinal 56 is also provided and includes a downwardly projecting drain pipe 57, which projects downwardly into an opening 58 in the holding tank 53.

An elongate vertically disposed vent pipe 59, having a downwardly opening keyhole slot 60 therein, engages a vertically disposed cylindrical coupling member 61 integral with the top wall of the holding tank 53. The coupling member 61 is provided with a transverse coupling pin 61*a* which engages the keyhole slot 60 in the vent pipe to secure the pipe to the coupling member. It is pointed out that the holding tank 53, the urinal 56, and the vent pipe 59 are all formed of a rigid, lightweight, strong plastic material.

The urinal 56 is provided with a rearwardly projecting pin 62 which projects into an opening in the vent pipe 59, and the urinal is also provided with a pair of front pins 63 that project therefrom and which project into openings in the front wall 14 to rigidly, but detachably, secure the urinal in place. The upper end portion of the vent pipe 59 projects upwardly through an embossed opening 64 in the top wall 15, as best seen in FIG. 2.

Assembly, or disassembly, of the novel portable knockdown toilet structure can be accomplished by a single operator in a matter of minutes and requires no special tools, with the exception of a conventional screw driver. When the toilet structure is to be assembled, the various components will have been transported by a suitable carrier.

In assembling the knock-down unit, the base will be positioned upon a supporting surface, such as the ground or the like, and the vertical walls of the unit will then be secured to the base. In this respect, one of the side walls will be secured to the clips 23 by aligning each slot 33 of the side wall with one of the clips and then urging the side wall downwardly. When the upper longitudinal edge defining each slot 33 engages the offset portion 25 of each clip, the side wall may then be shifted so that the lower longitudinal edge defining the slot is engaged by the downwardly facing shoulder 29*a* defined by the locking notch. This secures the side wall to the base. Thereafter, the rear wall will be secured to the base in the same manner.

The operator will then apply one of the clamping members 46 to the adjacent pair of edges of the side and rear walls. It will be seen that the legs of the clamping members converge slightly at their outer end portions and that the bight portion 49 has a slight camber or arc to it, imparting a resilient effect to the clamping member. The pins of the clamping member will be inserted into the adjacent mating slots of the side wall and the rear wall, and the clamping member will be urged downwardly, producing a clamping effect, and securely, but detachably, clamping the vertical edge portions of the side wall and rear wall together. Thereafter, the other side wall will be secured to the base and to the rear wall in the same sequence.

The front wall 14 will then be secured to the base, and its vertical edge portions will be secured to the side walls by the clamping members 46. When the front wall 14 is secured to the base, the front wall will be tipped slightly forwardly and the recesses 30*b* therein will be aligned with the edge 23*a*. The outturned lower edge portion of the front wall will be cammed behind the intermediate portion 23*b* of each clip 23*a* to secure the front wall to the base. The clamping members 46 will then be applied to the front vertical edge portions of the front wall and the side walls.

Finally, the roof 15 will be positioned upon the vertical walls so that the slots 45 therein are each positioned adjacent one of the cam locks 36. The operator will then shift each cam lock 36 from its unlocked position to its locked position, as illustrated in FIG. 8. It will be appreciated that the detent 39 will be seated in the detent opening 42 when each cam lock is in the unlocked condition. When each cam lock is shifted to the locked condition, the detent 39 will be seated in the opening 43, and the locking hook 41 will project through the associated slot 45 and engage the adjacent edge portion of the top wall. Again, it will be noted that the attachment of the top wall to the vertical walls requires a minimum of effort and the mere manipulation of the cam locks.

The holding tank 53 will then be positioned in the cavity defined between the intermediate and rear transverse members of the base and the pins 55 will be secured to the side walls. The urinal will then be secured to the front wall and the drain 58 will be connected to the opening 58*a* in the holding tank. Finally, the vent pipe will be secured to the coupling member 61*a* of the holding tank and will project upwardly through the roof 15.

Disassembly of the toilet structure may be accomplished in the reverse order. Thus, an operator will first shift each of the cam locks 36 from the locked condition to the unlocked condition and will then remove the top wall from the vertical walls. The operator will next remove the clamping members 46 from clamped relation with respect to adjacent vertical edge portions of adjacent vertical walls. The operator may then disengage the vertical walls from the base by shifting each vertical wall so that the edges of the slot clear the shoulder 29, and thereafter vertically removing the vertical walls from the clips. Finally, the holding tank and urinal and vent pipes may be removed.

With this arrangement, a single operator may readily assemble or disassemble a plurality of the toilet structures in only a matter of minutes.

It will further be appreciated that, because of the construction of the various components, these components may be stacked on a carrier vehicle to permit the transport of a large number of units, while minimizing the space requirements. For example, the side walls and rear wall may be placed in a single stack, and the front walls with the attached doors may be placed in another. The bases may be arranged in stacked relation, and the holding tank and other units may be arranged together. Damaged components, such as a damaged vertical wall, may be readily replaced without requiring replacement of the entire unit.

From the foregoing, it will be seen that we have provided a novel knock-down portable toilet structure which is capable of ready assembly and disassembly, while permitting efficient transport of the units in a disassembled condition.

Thus, it will be seen that we have provided a novel portable knock-down toilet unit, which is not only of simple and inexpensive construction, but one which functions in a more efficient manner than any heretofore known comparable structure.

What is claimed is:

1. A knock-down portable toilet structure comprising a generally rectangular-shaped base, a roof, vertical, generally rectangular-shaped side walls, front wall, and rear wall, said roof, and each of said side, front, and rear walls being formed of molded plastic material, and each side, front, and rear wall, respectively, having a substantially horizontal lower edge portion said structure housing a holding tank to receive excrement and a toilet seat and lid covering a receiving opening in the top of said tank, quick disconnect means on said base engaging cooperating means on the lower edge portion of each said side, front, and rear walls, respectively, to permit ready attachment of the vertical walls to the base and permitting ready detachment therefrom, each side, front, and rear wall having opposed vertical edge portions flaring outwardly from the general plane of each wall, each vertical edge portion of each wall having a plurality of similar, vertically spaced apart, vertically extending outwardly and upwardly opening slots therein, the vertical edge portion of one of said vertical walls being disposed in contiguous relation to the vertical edge on an adjacent wall so that a slot in the vertical edge portion of one wall is disposed in mating relation with a slot in the contiguous end portion of an adjacent wall, a plurality of substantially identical vertically disposed elongate U-shaped resilient clamping members formed of plastic material, each U-shaped clamping member including a pair of legs interconnected by an integral bight portion, said bight portion being slightly cambered inwardly and said legs converging slightly towards each other from the bight portion thereof to impart a resiliency to the U-shaped member, a plurality of vertically spaced apart pins extending between and secured to the legs of each U-shaped clamping member, the pins of each U-shaped clamping member engaging in the mating slots of the contiguous vertical edge portions of a pair of adjacent vertical walls and cooperating with the slots to cause the legs of the U-shaped clamping members to engage and clamp the contiguous edge portions together, each vertical side, front, and rear wall having a substantially horizontal upper edge portion, and quick disconnect locking means on the upper edge portion of each of said vertical front, rear, and side walls, respectively, engaging cooperating means on said roof adjacent the peripheral edge portion of the latter to permit ready attachment of the roof to the vertical side, front, and rear walls to permit ready attachment and detachment of the roof to the vertical walls.

2. The knock-down portable toilet structure as defined in claim 1 wherein said cooperating means on said base comprises a plurality of clips secured thereto, said means on the lower edge portion of each of said vertical side, front, and rear walls, respectively, comprising a plurality of elongate slots extending transversely of the associated vertical wall, each clip projecting through a slot in one of said vertical walls to releasably secure each vertical wall to the base.

3. The knock-down portable toilet structure as defined in claim 2 wherein each clip has a notch therein defining a generally horizontal, downwardly facing shoulder overlying an edge defined by the associated slot in the associated vertical wall to releasably lock the associated vertical wall to the base when the vertical wall is shifted in a transverse direction.

4. The knock-down portable toilet structure as defined in claim 2 wherein the lower edge portion of each of said vertical side, front, and rear walls, respectively, extends angularly outwardly and downwardly with respect to the general plane of the associated vertical wall.

5. The knock-down portable toilet structure as defined in claim 1 wherein said quick disconnect locking means on the upper edge portion of each of said vertical front, rear, and side walls, respectively, comprising a plurality of similar cam lock members, each being pivotally connected to the associated vertical wall for pivotal movement relative thereto between the locking and release positions, said means on said roof comprising a plurality of elongate slots therein extending substantially parallel to the associated edge thereof, each cam lock member projecting through one of said slots to engage the top wall when each cam lock member is in the locking position to releasably secure the roof to the vertical walls.

6. The knock-down portable toilet structure as defined in claim 5 and cooperating detent means on each cam member and the associated vertical wall for releasably retaining each cam member in the locking or release positions.

7. The knock-down portable toilet structure as defined in claim 5 wherein the upper edge portion of each of said vertical front, rear, and side walls, respectively, extends angularly upwardly and outwardly with respect to the general plane of the associated vertical wall.

8. The knock-down portable toilet structure as defined in claim 5 wherein each of said cam lock members is provided with an eccentric locking hook for engaging the peripheral edge portion of the roof when the cam member is in the locking position.

9. A knock-down portable toilet structure comprising a generally retangular-shaped base, a top wall, vertical generally retangular-shaped side walls, front wall, and rear wall, each vertical side, front, and rear wall, respectively, having a substantially horizontal lower edge portion, said top wall and each of said side, rear, and front walls being formed of a molded plastic material said structure housing a holding tank to receive excrement and a toilet seat and lid covering a receiving opening in the top of said tank, means on the lower edge portion of each of said vertical side, front, and rear walls, respectively, engaging cooperating means on said base to permit ready attachment of the vertical walls to the base and ready detachment therefrom, each vertical side, front, and rear wall having opposed vertical edge portions flaring outwardly from the general plane of the wall, each vertical edge portion having a plurality of similar vertically spaced apart outwardly and upwardly opening slots therein, a plurality of substantially identical elongate resilient clamping members, each being formed of a plastic material, each being of generally U-shaped cross-sectional configuration and defining a pair of legs and a bight portion extending between said legs, said bight portion being slightly cambered inwardly and said legs converging slightly towards each other from the bight portion thereof of impart a resiliency to the U-shaped member, each clamping member having a plurality of vertically spaced apart locking pins secured thereto and extending transversely between and secured to said legs, adjacent vertical edge portions of a pair of adjacent vertical side, front, and rear walls being received within the U-shaped cavity of a clamping member, and the locking pins thereof engaging in the slots of the adjacent vertical edge portions of the adjacent vertical walls so that the legs of each clamping member engage and releasably clamp a pair of vertical walls together, and releasably locking means on the upper edge portion of each of said vertical front, rear, and side walls, respectively, engaging means on said top wall adjacent the peripheral edge portions of the latter to readily attach the top wall to the vertical side, front, and rear walls and to permit ready detachment therefrom.

* * * * *